US005715889A

United States Patent [19]

Peterson

[11] Patent Number: 5,715,889

[45] Date of Patent: Feb. 10, 1998

[54] HEAT EXCHANGER AND THE METHOD FOR PRODUCING SAME

[75] Inventor: Dean R. Peterson, Germantown, Tenn.

[73] Assignee: Ardco, Inc., Chicago, Ill.

[21] Appl. No.: 643,336

[22] Filed: May 6, 1996

[51] Int. Cl.[6] ..... F28F 9/013

[52] U.S. Cl. ..... 165/67; 165/121; 165/151

[58] Field of Search ..... 165/637, 121, 165/151

[56] References Cited

U.S. PATENT DOCUMENTS

| | | | |
|---|---|---|---|
| 2,013,309 | 9/1935 | Jackson | 257/240 |
| 3,139,925 | 7/1964 | Kramer | 165/67 |
| 3,199,581 | 8/1965 | Kritzer | 165/67 |
| 3,395,753 | 8/1968 | Falso | 165/67 X |
| 3,877,518 | 4/1975 | Dreksler | 165/150 |
| 4,262,741 | 4/1981 | Rothenbucher | 165/68 |
| 4,898,232 | 2/1990 | Ochiai et al. | 165/151 |
| 5,020,587 | 6/1991 | Mongia et al. | 165/82 |

FOREIGN PATENT DOCUMENTS

| | | | |
|---|---|---|---|
| 401590 | 12/1990 | European Pat. Off. | 165/67 |
| 3-251691 | 11/1991 | Japan | 165/67 |

*Primary Examiner*—Allen J. Flanigan

*Attorney, Agent, or Firm*—Walker, McKenzie & Walker, P.C.

[57] ABSTRACT

An improvement in a fin and tube heat exchanger of the type used in condensers, evaporators, and fluid coolers in refrigeration systems and the like. The fin and tube heat exchanger comprises at least one coil including fins, tubes and a support. The improved fin and tube heat exchanger has no end plates or center plates by which typically the coils are supported, but the coil of the improved fin and tube heat exchanger is supported solely by the fins thereof resting on the support. The fins of the coils are typically straight along the lower edges thereof from end to end, but alternatively may be notched and a flange formed adjacent each notch to rest upon the support with the support being received in the notch.

8 Claims, 3 Drawing Sheets

HEAT EXCHANGER AND THE METHOD FOR PRODUCING SAME

BACKGROUND OF THE INVENTION

1. Field of the Invention

The present invention relates, in general, to an improved fin and tube heat exchanger and the method for producing same for use in condensers, evaporators, or fluid coolers in refrigeration systems.

2. Information Disclosure Statement

Traditionally, end plates and center plates have been used as coil supports in fin and tube heat exchangers. The fluid carrying tubes of the coils have passed through holes in the end and center plates with a tight fit between the holes and the tubes. This tight fit has been a source of wear due to vibration and thermal expansion and contraction. Thus, these joints have tended to be leak points in fin and tube heat exchangers. One attempt at a solution to this problem was disclosed in U.S. Pat. No. 5,020,587, wherein the fluid carrying tubes are directly connected to the heat transfer fins with the fins in turn being connected to non-fluid carrying support tubes that are expanded into holes in the end plates and center plates. The end plates and center plates have holes that are substantially larger than the outside diameter of the fluid carrying tubes such that the fluid carrying tubes may pass through the holes without any contact allowing for freedom of movement, otherwise referred to in the '587 patent as the tubes being in "free floating relationship with the end plates and center plates".

There is a need for a more effective and more economical approach to the above mentioned problem of wear and leakage due to vibration and thermal expansion at the joints of the tubes and the end and center plates.

A preliminary patentability search in Class 165, subclasses 82, 150, and 151, produced the following patents, some of which may be relevant to the present invention: Jackson, U.S. Pat. No. 2,013,309, issued Sep. 3, 1935; Kritzer, U.S. Pat. No. 3,199,581, issued Aug. 10, 1965; Dreksler, U.S. Pat. No. 3,877,518, issued Apr. 15, 1975; Rothenbucher, U.S. Pat. No. 4,262,741; and Ochiai et al, U.S. Pat. No. 4,898,232.

SUMMARY OF THE INVENTION

The present invention is an improved apparatus and method for supporting coils in fin and tube heat exchangers in which the coil is solely supported by the fins resting upon supporting means such as a frame or the like.

It is an object of the present invention to provide such an apparatus and method in which the need for end plates and center plates is non-existent so that the previous problems relative to wear and leakage due to vibration and thermal expansion at the joints of the tubes and the end plates are entirely eliminated.

A further object is to provide a method and means for supporting a coil that is more effective and more economical than previous methods and means for the support of a coil.

A further object is to provide such a method and means for supporting a coil in which the supporting means contacts only the fins to support the coil.

DESCRIPTION OF THE PREFERRED EMBODIMENT

Figure 1:
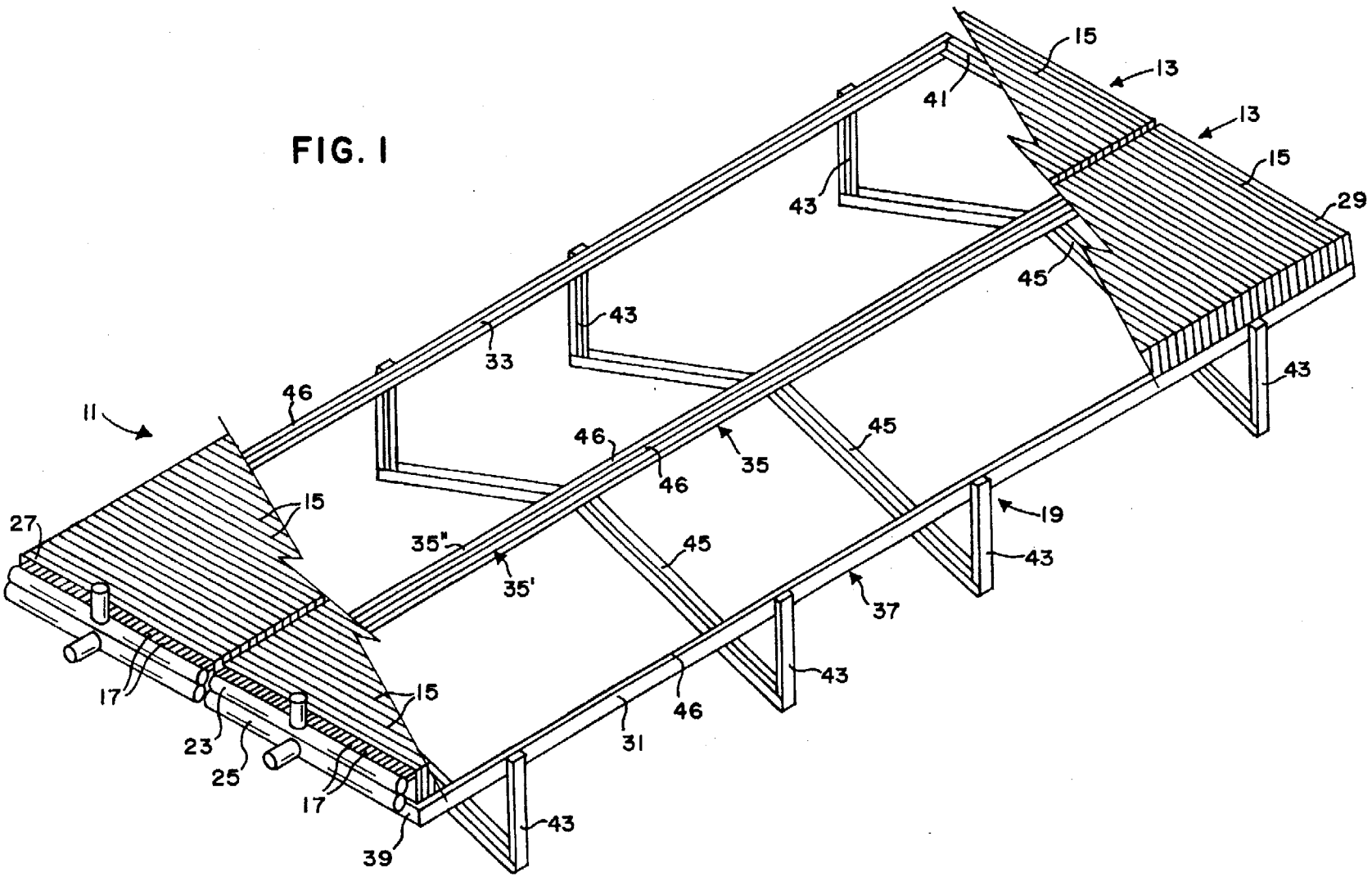
FIG. 1 is a perspective view of the present invention with parts broken away and removed for purposes of illustration.

The present invention relates to a fin and tube heat exchanger 11 which comprises, in general, at least one coil 13 including fins 15 and tubes 17, and support means 19 for supporting coil 13 with the coil being solely supported by fins 15 resting upon the support means 19. Fin and tube heat exchanger 11 includes the usual fans 16 well known to those skilled in the art.

Although in the drawings the fin and tube heat exchanger 11 is illustrated in the form of a condenser of the type used in refrigeration systems, it will be understood that the term "fin and tube heat exchanger" is used to denote not only such condensers but also evaporators, and fluid coolers in refrigeration systems and the like without departing from the spirit and scope of the present invention.

More specifically, coil 13 is of a type well known to those skilled in the art and includes the usual plurality of parallel fins 15 preferably formed of a suitable metal such as stainless steel, copper, aluminum, or the like. Fins 15 are provided with a plurality of holes 21 in any desired pattern and number. Also, coil 13 includes a plurality of the tubes 17 which extend through holes 21 in the usual manner and in a typical condenser coil are connected to an inlet header 23 from where the refrigeration fluid is introduced into one end of the tubes 17 with the opposite end of the tubes 17, after one or more passes, being connected to the outlet header 25 from where the cooled fluid typically proceeds to the next station in the refrigeration cycle. It will be understood that tubes 17 respectively have the usual bends therein, not shown, at the opposite (rearward) end 29 of the coil 13 from the headers 23, 25 to direct the fluid back towards the headers after a pass is made from the front end 27 to the rearward end 29 of the coil. Also, it will be understood that coils may have other distribution and collection means for directing the flow to and from the tubes.

Tubes 17 are fixed relative to the fins 15 in any suitable well known manner, as for example, by mechanically expanding the tubes 17 into the fins 15. The fins are preferably provided with collars, not shown, which are well known and which space the fins from one another. The length of the collars may be changed to give a different spacing between the fins 15. Typically, 4 to 14 fins are provided per inch. When tubes 17 are expanded into the fins 15 there is a bond formed between the tubes and the fins which provides good heat transfer and the connections between the tubes and the fins are very rigid.

Typically, the fin and tube heat exchangers 11 may have one coil 13 or may have two coils 13 in side-by-side relationship. In the drawings a fin and tube heat exchanger 11 having two coils 13 is shown and will be first described, but it will be understood that a fin and tube heat exchanger 11 having one or more coils 13 may be provided without departing from the spirit and scope of the present invention.

Figure 2:
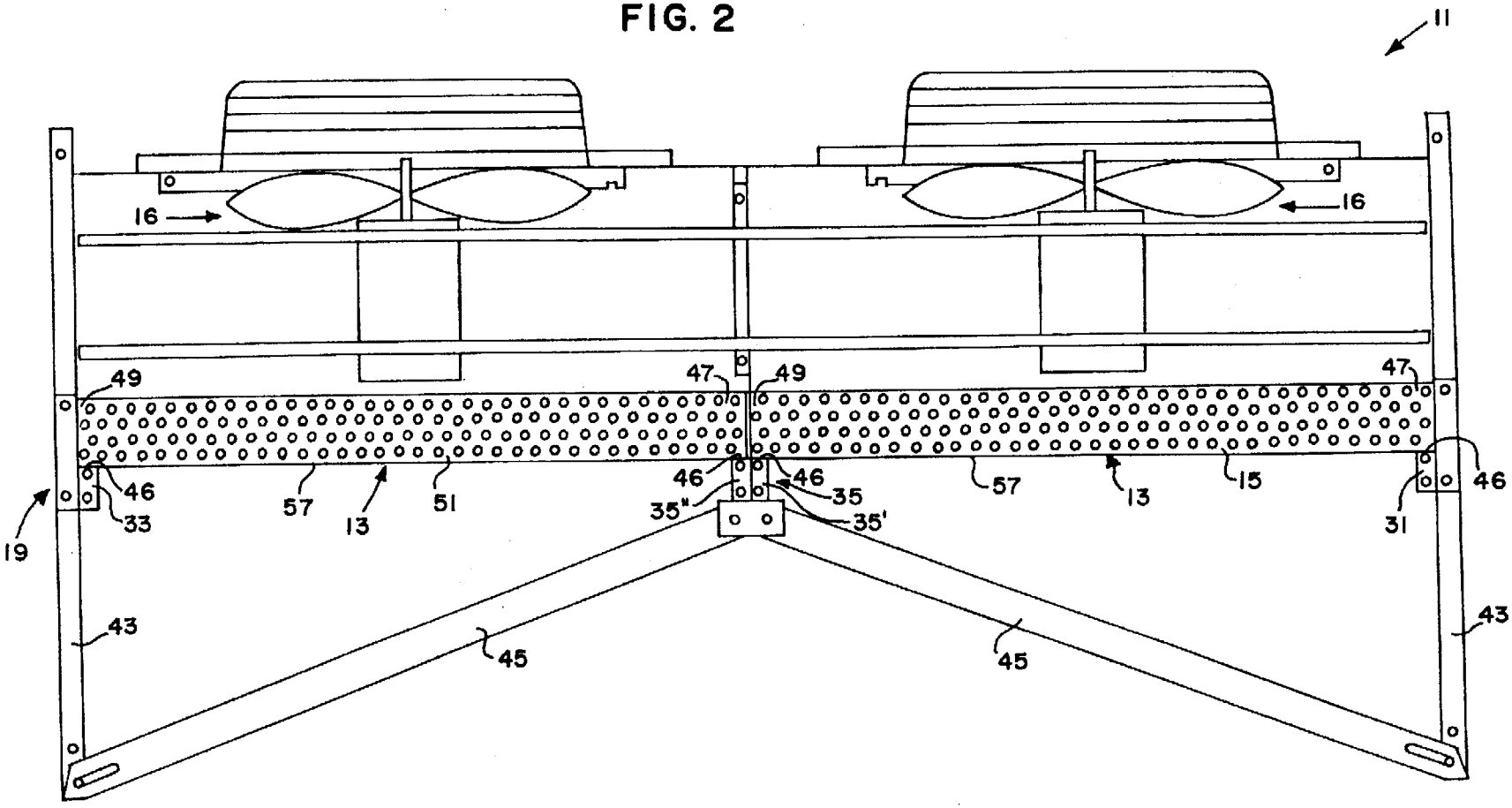
FIG. 2 is an enlarged cross-sectional view of the present invention.
Figure 3:
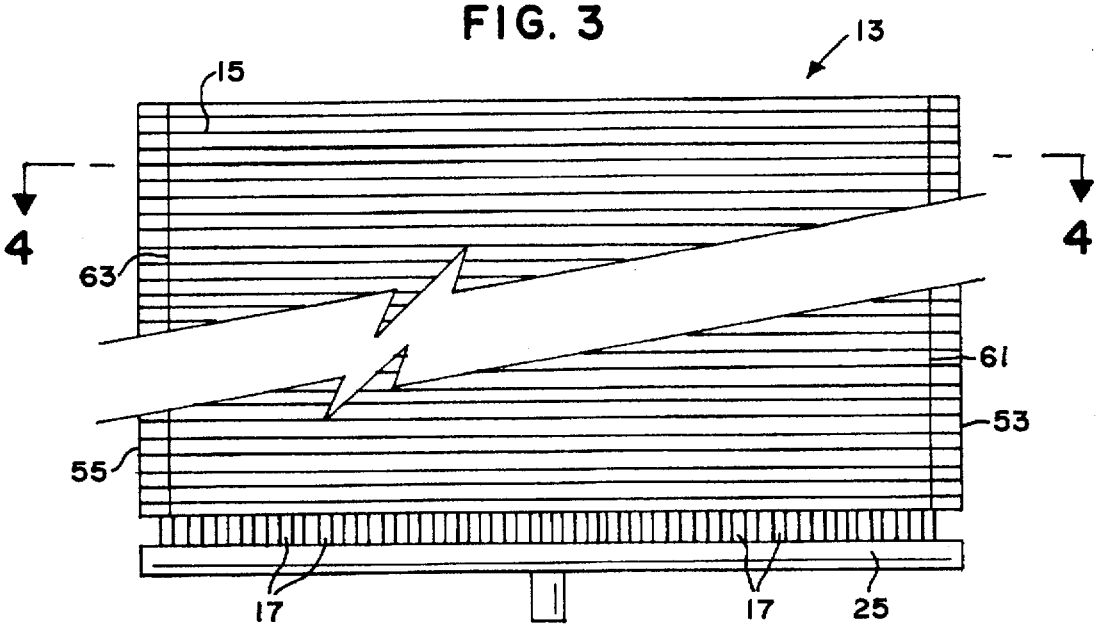
FIG. 3 is a bottom plan view of the coil of the present invention.
Figure 4:
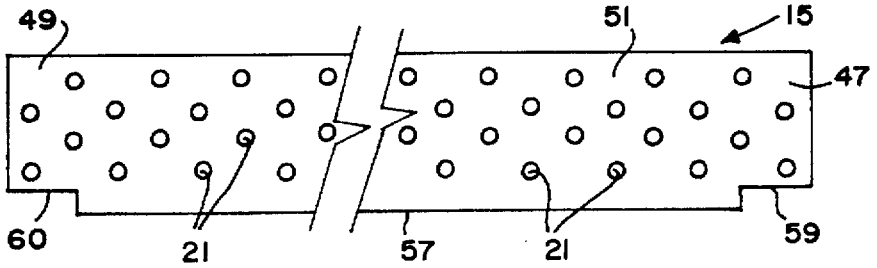
FIG. 4 is an front elevational view of one of the fins of the present invention showing the notch portions at the opposite ends of the fin.
Figure 5:
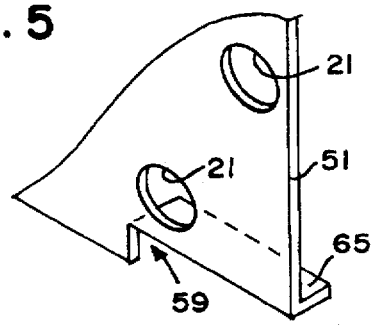
FIG. 5 is an enlarged fragmentary perspective view showing the formation of the flange adjacent the notch portion at one end of a fin of the present invention.

Referring now particularly to FIGS. 1 and 2 of the drawings, it will be seen that the support means 19 for a fin and tube heat exchanger 11 having two coils 13 includes an elongated first support member 31, an elongated second support member 33, and an elongated central support member 35. Second support member 33 is disposed in spaced apart parallel relationship with first support member 31. Central support member 35 is disposed between first and second support members 31, 33 and in spaced parallel relationship with first and second support members 31, 33. Also, first and second support members 31, 33 are part of a rigid rectangular frame or framework 37 which also includes front end member 39 and rearward end member 41. Front end member 39 extends across the front end of framework 37 and is fixedly and rigidly attached by suitable means to the forward ends of first and second supports 31, 33 and to the forward end of central support 35. Similarly, rearward end member 41 extends across the rearward end of framework 41 and is fixedly and rigidly attached by suitable means to the rearwards ends of first and second supports 31, 33 and to the rearward end of central support 35.

Legs 43 are fixedly and rigidly attached to first and second support members 31, 33 at spaced intervals along the length of framework 37 and extend downwardly to a supporting surface, not shown. Diagonal members 45 are fixedly and rigidly attached to the lower ends of legs 43 from where they respectively extend upwardly at an angle to their rigid and fixed attachment to central support member 35. First and second support members 31, 33, and front and rear end members 39, 41 are of suitable construction to preferably present a flat surface 46 upon which fins 15 rest. Thus, a suitable construction is preferably the channel shape shown in the drawings with the upper flanges thereof which provide the flat surface 46 extending horizontally. Central support member 35 is preferably formed from two channel members 35', 35" connected together by suitable means in back-to-back relationship to form flat surfaces 46.

Although in the drawings and in description herein member 35 has been shown and described as being supported by diagonal members 45, it will be understood that member 35 could be supported in many different ways without departing from the spirit and scope of the present invention, as for example, by adding legs to support member 35, by supporting member 35 from the motor rails, or by making support member 35 more rigid so that additional support for member 35 is not needed.

It will be seen in FIGS. 1 & 2, that one of coils 13 spans the space between first support member 31 and central support member 35 with the fins 15 thereof resting on support member 31 along the ends 47 of the fins 15 and resting on channel member 35' along the ends 49 of the fins 15, and the other one of the coils 13 spans the space between second support member 33 and central support member 35 with the fins 15 thereof resting on support member 33 along the ends 49 of the fins 15 and resting on channel member 35" along the ends 47 of the fins 15. It will be understood that the body 51 of each of the fins 15 in each of the coils 13 are disposed in vertical planes and extend transversely across the coil. The group of fins 15 at the front and rear ends 27, 29 of each of the coils 13, preferably but not necessarily, respectively rest on front and rear end members 39, 41. Also, it will be understood that the ends 47, 49 of the fins respectively form the opposite side edges 53, 55 of the coils 13. In addition, it will be understood that the tubes 17 of the coils 13 extend longitudinally of the coils, i.e., perpendicularly to the fins 15 in the usual manner. From the foregoing description of the relationship of the coils 13 and framework 37, it will be understood that the coils 13 are solely supported by the fins 15 of the coils 13 resting upon support means 19. Also, it will be understood that no end plates or center plates are provided or needed with the fin and tube heat exchanger 11 of the present invention, so that problems relative to wear and leakage due to vibration and thermal expansion at the joints of the tubes and the end plates in previous fin and tube heat exchangers are entirely eliminated.

As previously stated one coil 13 may be utilized instead of two coils side-by-side. When one coil 13 is utilized it will be understood that the framework thereof may be modified, as appropriate to accommodate only one coil. For example, only one half of framework 37 will be needed, so that it will not be necessary to have a central support member but only two side support members with the support members being spaced apart one half the distance between support members 31, 33 of the double unit shown in FIGS. 1 & 2.

It should be pointed out that the location of the support means 19 is not critical. The location of the support means has been chosen preferably to be at the ends of fins 15 for convenience and to minimize air flow blockage, but, for example, the support means could be moved several inches from the ends of the fins 15. Also, it has been chosen preferably to make the support member members 31, 33, 35 continuous from one end of coils 13 to the other. However, there could be breaks in the supports and still provide adequate support, without departing from the spirit and scope of the present invention.

Alternatively, instead of the fins 15 being straight, i.e. unnotched along the entire length of the respective bottom edges 57 thereof, as seen in FIG. 2, the bottom edges of fins 15 may be notched, as shown at 59, 60 at the opposite ends 47, 49 of fins 15. The preferred method of providing the notches 59, 60 is by cutting fins 15 along lines 61, 63 spaced inwardly from the opposite ends of the fins and then bending the metal of each fin so it is perpendicular to the main body 51 of the fin to establish flanges 65 which when assembled with framework 37 will rest on flat surface 46 of the framework with the respective support members 31, 33 (in the case of a single coil 13 being supported and with central support member 35 being omitted) or support member 35 and support members 31, 33 (in the case of two coils 13 being supported), extending into the respective notches 59, 60. It should be pointed out that the shape and location of the fin notches 59, 60 is not critical. For example, the notches 59, 60 could be moved inwardly from the ends of the fins 15 and could be rounded to mate with rounded supports without departing from the spirit and scope of the present invention.

Although the present invention has been described and illustrated with respect to a preferred embodiment and a preferred use therefor, it is not to be so limited since modifications and changes can be made therein which are within the full intended scope of the invention.

I claim:

1. In a refrigeration system, a fin and tube heat exchanger comprising:

(a) a coil, said coil including:

i. a plurality of parallel vertically extending fins each having a body portion, a bottom edge, and having holes through said fins, said body portions of said fins extending vertically upward from said bottom edges, and ii. a plurality of tubes respectively extending through said holes with said tubes being fixedly attached to said fins, and (b) support means horizontally supporting said coil said coil being solely supported adjacent the bottom edges of said fins by said fins resting upon said support means.

2. The fin and tube heat exchanger of claim 1 in which said support means includes a pair of support members disposed in spaced apart parallel relationship with one another, in which said body portions of said fins respectively have notches therein, and in which said coil is solely supported by said fins resting upon said pair of support members at said notches.

3. The fin and tube heat exchanger of claim 2 in which said fins respectively include flanges at said notches with said flanges respectively extending perpendicular to said main body portions of said fins.

4. In a refrigeration system, a fin and tube heat exchanger comprising:

(a) a pair of coils, each of said coils including:

i. a plurality of parallel vertically extending fins each having a body portion, a bottom edge and having holes through said fins, said body portions of said fins respectively extending vertically upward from said bottom edges thereof and ii. a plurality of tubes respectively extending through said holes with said tubes being fixedly attached to said fins, and (b) support means for supporting said coils, said coils extending horizontally and being solely supported by said bottom edges of said fins resting upon said support means.

5. A fin and tube heat exchanger comprising:

(a) a pair of coils, each of said coils including:

i. a plurality of parallel fins having holes therethrough, and ii. a plurality of tubes respectively extending through said holes with said tubes being fixedly attached to said fins, and (b) support means for supporting said coils, said coils being solely supported by said support means, said support means including a first support member, a second support member and a central support member, said second support member being disposed in spaced apart parallel relationship with said first support member, said central support member being disposed between said first and second support members and in spaced parallel relationship with said first and second support members, and in which one of said pair of coils is solely supported by the fins of said one of said pair of coils resting upon said first support member and said central support member, and the other of said coils is solely supported by the fins of said other of said pair of coils resting upon said second support member and said central support member.

6. The fin and tube heat exchanger of claim 5 in which said fins of said one of said coils and said other of said coils respectively include main body portions having notches therein, and in which said coils rest upon said support members at said notches.

7. The fin and tube heat exchanger of claim 5 in which said fins respectively include flanges at said notches with said flanges respectively extending perpendicular to said main body portions of said fins.

8. A method for producing a fin and tube heat exchanger for refrigeration systems without end plates and center plates comprising the steps of:

(a) providing a fin and tube heat exchanger coil including a plurality of parallel fins having bottom edges, a body portion and having holes through said fins, and including a plurality of tubes respectively extending through said holes, said body portion of said fins extending vertically from said bottom edges, (b) providing support means for said coil including at least a pair of parallel spaced apart support members, and (c) supporting said fin and tube heat exchanger coil in a horizontal position from said support members solely by said bottom edges of said fins resting upon said support members.

* * * * *